United States Patent [19]

Schulz et al.

[11] Patent Number: 4,525,897

[45] Date of Patent: Jul. 2, 1985

[54] FILAMENT DRAWING FRAME WITH VARIABLE ROLLER-PAIR SPACING

[75] Inventors: Günter Schulz, Ebersbach; Jakob Bothner, Göppingen-Jebenhausen, both of Fed. Rep. of Germany

[73] Assignee: Zinser Textilmaschinen GmbH, Ebersbach, Fed. Rep. of Germany

[21] Appl. No.: 570,777

[22] Filed: Jan. 16, 1984

[30] Foreign Application Priority Data

Jan. 15, 1983 [DE] Fed. Rep. of Germany ..... 3301239

[51] Int. Cl.[3] ..... D01H 5/74

[52] U.S. Cl. ..... 19/260; 19/293

[58] Field of Search ..... 19/260, 293

[56] References Cited

U.S. PATENT DOCUMENTS 3,479,700 11/1969 Livingston ..... 19/260

*Primary Examiner*—Louis K. Rimrodt

*Attorney, Agent, or Firm*—Karl F. Ross; Herbert Dubno

[57] ABSTRACT

A filament drawing apparatus has a support, at least two pairs of rollers spaced apart on the support in a travel direction so that a filament to be drawn passes in the direction between the rollers of both pairs, and a drive having at least two output shafts and including a transmission for rotating the shafts at different speeds. One of the shafts is connected to one of the roller pairs and the other roller pair is displaceable on the support in the travel direction relative to the one roller pair. An input gear is mounted on the other output shaft and an output gear is mounted on one of the rollers of the other roller pair and is displaceable therewith in the direction. An input link has one end pivoted at the other output shaft and an opposite end and an output link has one end pivoted at the one roller of the other roller pair and has an opposite end pivoted on the opposite end of the input link. An intermediate gear pivoted on the opposite ends meshes with and interconnects the input and output gears. Thus rotation of the other output shaft is transmitted from the input gear through the intermediate gear and output gear to the one roller of the other roller pair.

12 Claims, 3 Drawing Figures

FILAMENT DRAWING FRAME WITH VARIABLE ROLLER-PAIR SPACING

FIELD OF THE INVENTION

The present invention relates to a filament drawing apparatus. More particularly this invention concerns a drawing frame of the type normally used with cotton filaments immediately upstream of a spinning apparatus and wherein the spacing between adjacent roller pairs can be varied.

BACKGROUND OF THE INVENTION

It is standard practice in the spinning of yarn or thread to draw out one or more slivers of fibers, typically cotton ones, in a drawing frame formed by a plurality of pairs of rollers. These roller pairs are spaced apart in the travel direction of the filaments or sliver and are rotated at speeds that increase upstream to downstream, with the furthest downstream roller pair rotating at a peripheral speed that is a multiple of that of the upstream pair, typically by a factor equal to the number of slivers that are being combined.

In a standard system the furthest downstream roller pair is not displaceable in the travel direction, but is mounted directly on the spinning apparatus for rotation about a fixed axis. The other roller pairs are carried in journal blocks slidable in the travel direction on a rail extending in the travel direction. Means is provided for locking these slidable journal blocks in place on the rail at spacings determined by the staple length of the fiber being drawn and other factors.

In a standard system described in *Die moderne Baumwollspinnerei* by Fritz Walz (Bernh. Friedr. Voigt Verlag, Berlin-Hamburg, page 267) an arrangement is described wherein the furthest downstream roller pair is fixed on the ring spinner frame and the lower roller of each of the roller pairs upstream therefrom is connected via a respective telescoping shaft and two universal joints to the respective output shaft of the drive. In this manner rotation is transmitted from the transmission output shafts to the respective roller pairs irrespective of their relative positions.

This arrangement is disadvantageous in that the entire drive arrangement must be relatively long to prevent the universal shafts from having to compensate for severe angular offsets. In addition the universal joints do not transmit torque smoothly, and are not capable of operating at high speeds over long periods of time.

OBJECTS OF THE INVENTION

It is therefore an object of the present invention to provide an improved filament-drawing apparatus.

Another object is the provision of such a filament-drawing apparatus which overcomes the above-given disadvantages, that is which can operate at high speed and that is of relatively short overall length.

SUMMARY OF THE INVENTION

A filament drawing apparatus has a support, at least two pairs of rollers spaced apart on the support in a travel direction so that filaments to be drawn pass in the direction between the rollers of both pairs, and a drive having at least two output shafts and including a transmission for rotating the shafts at different speeds. One of the shafts is connected to one of the roller pairs and the other roller pair is displaceable on the support in the travel direction relative to the one roller pair. According to this invention an input gear is mounted on the other output shaft and an output gear is mounted on one of the rollers of the other roller pair and is displaceable therewith in the direction. An input link has one end pivoted at the other output shaft and an opposite end and an output link has one end pivoted at the one roller of the other roller pair and has an opposite end pivoted on the opposite end of the input link. An intermediate gear pivoted on the opposite ends meshes with and interconnects the input and output gears. Thus rotation of the other output shaft is transmitted from the input gear through the intermediate gear and output gear to the one roller of the other roller pair.

This arrangement can be combined with any standard stretcher, flyer, spinning machine, or the like. Since continuous-mesh gearing is provided to make the connection between the transmission output shafts and the respective rollers, torque transmission will be perfectly uniform and even. High speeds can be used with none of the throw problems inherent in use of a universal joint. In addition the entire assembly can be made extremely compact, as the gears can all be coplanar. Helical gears can be used, and in fact the gearing can be set up to provide some of the stepdown normally needed for the respective rollers. According to this invention the one output shaft is directly connected to one of the rollers of the one roller pair.

To minimize wear of the apparatus according to this invention the support includes a housing containing the transmission means and a lubricating bath therefore. The support includes a generally dusttight housing containing the gears and links and has a slot that is elongated in the direction and through which the output gear is connected to the respective roller. This slot is provided with a sealing flexible flap. The interior of the housing is generally dry. In addition the intermediate gear is made of a synthetic resin, typically a polyamide like nylon, and the input gear and output gear are made of metal. Thus any wear of the gears will be confined to the synthetic-resin intermediate gear which can be switched at low cost.

The apparatus according to this invention can also have means for arresting one of the links on the housing against pivoting. This allows any vibration in the knee-type assembly of connector links to be eliminated. In addition each of these gear and link assemblies can be contained in its own dusttight housing.

The support according to this invention is provided with a journal sleeve in which the other output shaft is supported and on which the one end of the input link is pivoted. Furthermore a journal block is rotatably carrying the one roller of the other roller pair and provided with a sleeve on which the one end of the output link is pivoted. This makes the assembly very compact and robust.

DESCRIPTION OF THE DRAWING

The above and other features and advantages will become more readily apparent from the following, reference being made to the accompanying drawing in which.

SPECIFIC DESCRIPTION

Figure 2:
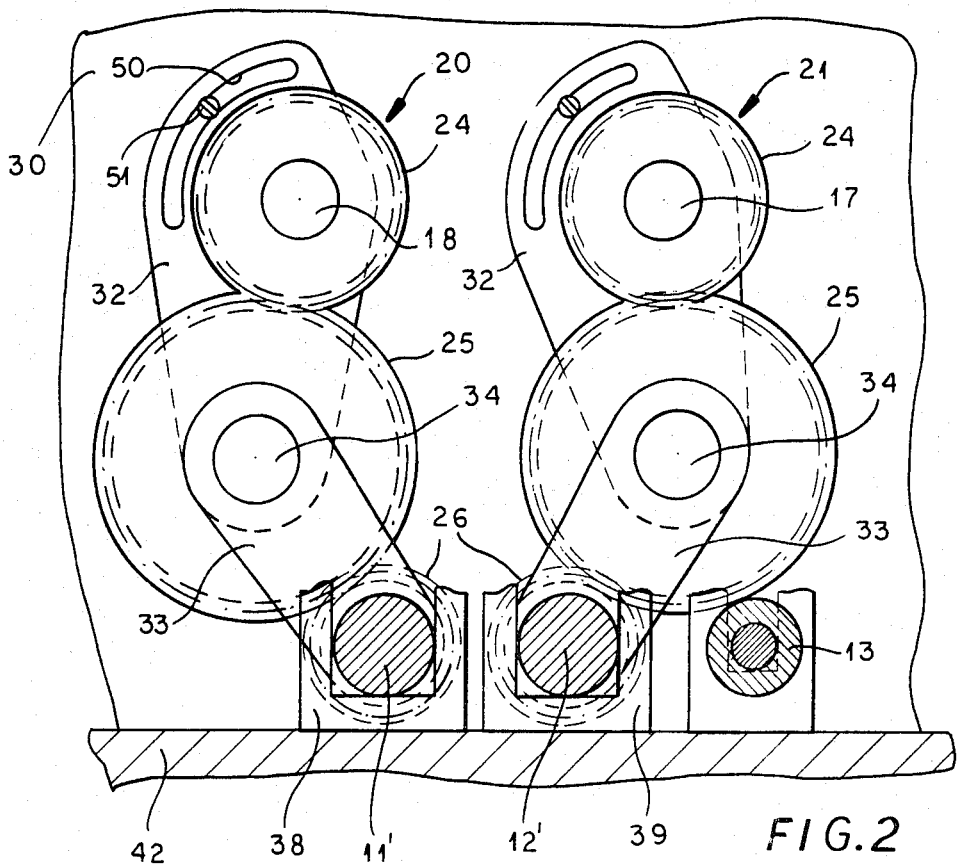
FIG. 2 is a section taken along line II—II of FIG. 1.
Figure 3:
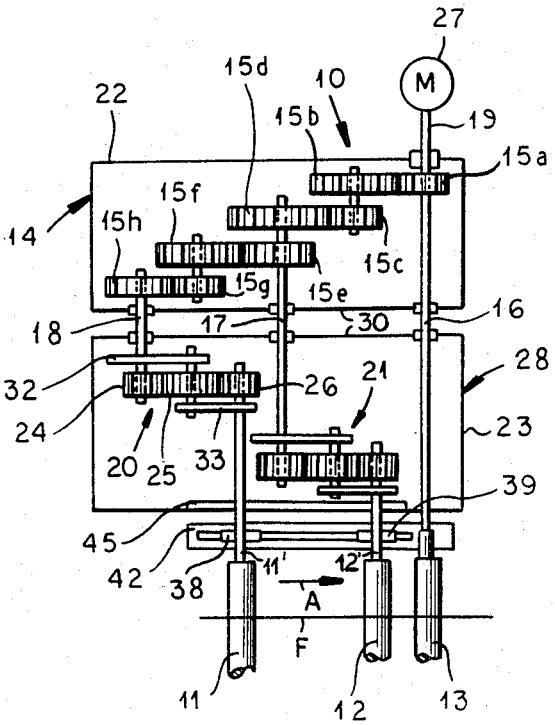
FIG. 3 is a largely schematic top view of the drive of this invention.
Figure 1:
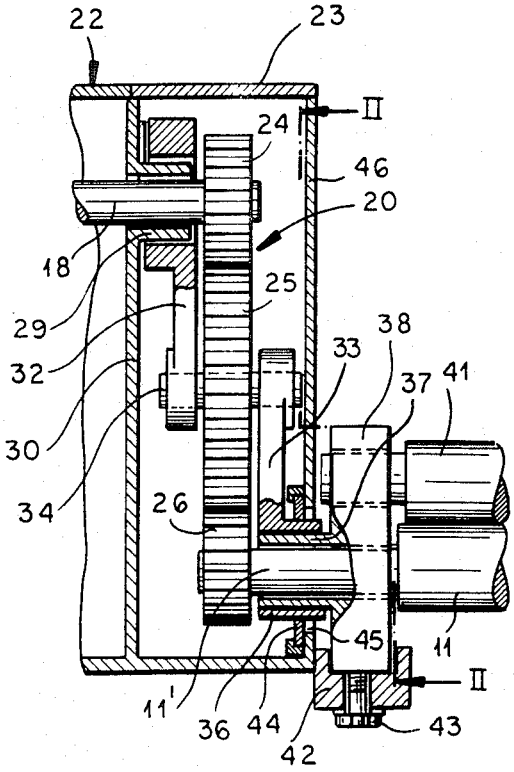
FIG. 1 is a vertical section through the drive according to the present invention.

As seen in FIG. 3 the drawing frame according to this invention comprises three lower rollers 11, 12, and 13 each of which bears upward against a respective upper roller 41 (FIG. 1 only) to draw out a filament or sliver F passing in a direction A through the frame. In standard manner the peripheral speeds of the rollers 11, 12, and 13 increase in the downstream direction, normally by a factor determined by the number of slivers being combined to form a single yarn. These rollers 11, 12, and 13 are rotated by a common drive 10 basically comprised of a double stepdown transmission 14 connected to a coupling unit 28.

The stepdown transmission 14 has a single input shaft 19 having one end connected to a variable-speed electric motor 27 and an opposite end constituting the first output shaft 16 of the transmission 14. A pinion 15*a* fixed on the shaft 19 meshes via two other gears 15*b* and 15*c* with a fourth gear 15*d* carried on a second output shaft 17. A fifth pinion 15*e* carried on this shaft 17 is in continuous engagement with a gear 15*h* carried on a third output shaft 18 by means of two further gears 15*f* and 15*g*. The shafts 16, 17, and 18 are rotatable about parallel and coplanar axes that are equispaced in the direction A and that produce a fixed stepdown, with the shaft 18 rotating at a fraction of the speed of the shaft 17 which in turn rotates at a fraction of the speed of the shaft 16. These gears 15*a*–15*h* are all contained in a sealed housing 22 that is filled with a lubricating-oil bath and that has an end wall 30 from which the shafts 16, 17, and 18 project.

The coupling unit 28 has a housing 23 that is in part formed by the wall 30 so that the shafts 16, 17, and 18 project into it. In fact the shaft 16 projects right through it and is directly connected to the downstream roller 13 which, therefore, is not displaceable in the direction A. The shafts 17 and 18 are connected via gear assemblies 20 and 21 to the rollers 11 and 12 which are carried in journals 38 and 39 that can slide in the direction A in a stationary U-section support rail 42 and which can be fixed therein by bolts 43.

The two gear assemblies 20 and 21 are of the knee type and are substantially identical. They may step down or step up the input speed, but are of fixed and unchanging ratios. Each of these assemblies 20 and 21 comprises a metal input gear 24 carried on the respective shaft 17 or 18, a polyamide intermediate gear 25 meshing with this input gear 24, and a metal output gear 26 carried and fixed on an extension 11' or 12' of the respective roller 11 or 12.

The common housing wall 30 is formed around each of the shafts 17 and 18 with a cylindrical journal sleeve 29 in which the respective shaft 17 or 18 is supported. This sleeve 29 externally pivotally supports the upper end of a link 32 carrying at its lower end a pivot pin 34 carrying the respective intermediate gear 26. The other end of each of these pins 34 is journaled in the upper end of another rigid link arm 33 having a lower end formed as an eye 36 carried on a sleeve-like journal extension 37 of the respective journal block 38 or 39. The eye 36 and journal sleeve 37 extend through a slot 45 formed in the front wall 46 of the housing 23. This slot 45 is provided with an elastomeric seal 44 that keeps dust and lint out of the interior of the housing 23, which is not a bath-type arrangement like the housing 22.

Each of the upper links 32 is formed with a part-circular axially throughgoing slot 50 centered on the axis of the respective shaft 17 or 18. A screw 51 engages through each of these slots 50 and is threaded into the wall 30 so that when tightened it angularly arrests the respective upper link 32, thereby locking the respective knee assembly 20 or 21 up.

With this system it is therefore possible to adjust the relative positions of the rollers 11, 12, and 13 within wide limits with no change whatsoever in their rotation rates. Once the rollers 11 and 12 are positioned, they will turn at the exact same speed they turned at in the previous position. Since constant-mesh gearing is employed between each shaft 17 and 18 and the respective rollers 12 and 11, a perfectly uniform product will be made.

We claim:

1. A filament drawing apparatus comprising:

a support;

at least two pairs of rollers spaced apart on the support in a travel direction, whereby filaments to be drawn pass in the direction between the rollers of both pairs;

a drive having at least two output shafts and including transmission means for rotating the shafts at different speeds, one of the shafts being connected to one of the roller pairs, the other roller pair being displaceable on the support in the direction relative to the one roller pair;

an input gear mounted on the other output shaft;

an output gear mounted on one of the rollers of the other roller pair and displaceable therewith in the direction;

an input link having one end pivoted at the other output shaft and an opposite end;

an output link having one end pivoted at the one roller of the other roller pair and having an opposite end pivoted on the opposite end of the input link; and an intermediate gear pivoted on the opposite ends and meshing with and interconnecting the input and output gears, whereby rotation of the other output shaft is transmitted from the input gear through the intermediate gear and output gear to the one roller of the other roller pair.

2. The filament drawing apparatus defined in claim 1 wherein the one output shaft is directly connected to one of the rollers of the one roller pair.

3. The filament drawing apparatus defined in claim 1 wherein the support includes a housing containing the transmission means and a lubricating bath therefore.

4. The filament drawing apparatus defined in claim 1 wherein the support includes a generally dusttight housing containing the gears and links.

5. The filament drawing apparatus defined in claim 4 wherein the housing has a slot that is elongated in the direction and through which the output gear is connected to the respective roller and is provided with a flexible flap sealing the slot.

6. The filament drawing apparatus defined in claim 4 wherein the interior of the housing is generally dry.

7. The filament drawing apparatus defined in claim 1 wherein the intermediate gear is made of a synthetic resin.

8. The filament drawing apparatus defined in claim 7 wherein the input gear and output gear are made of metal.

9. The filament drawing apparatus defined in claim 1, further comprising means for arresting one of the links on the housing against pivoting.

10. The filament drawing apparatus defined in claim 1 wherein the support is provided with a journal sleeve in which the other output shaft is supported and on which the one end of the input link is pivoted.

11. The filament drawing apparatus defined in claim 1, further comprising a journal block rotatably carrying the one roller of the other roller pair and provided with a sleeve on which the one end of the output link is pivoted.

12. In a filament drawing apparatus comprising:

a support;

at least two pairs of rollers spaced apart on the support in a travel direction, whereby filaments to be drawn pass in the direction between the rollers of both pairs;

a drive having at least two output shafts and including transmission means for rotating the shafts at different speeds, one of the shafts being connected to one of the roller pairs, the other roller pair being displaceable on the support in the direction relative to the one roller pair;

an input gear mounted on the other output shaft;

an output gear mounted on one of the rollers of the other roller pair and diplaceable therewith in the direction; and an intermediate gear meshing with and interconnecting the input and output gears, whereby rotation of the other output shaft is transmitted from the input gear through the intermediate gear and output gear to the one roller of the other roller pair; the improvement comprising:

an input link having one end pivoted at the other output shaft and an opposite end; and an output link having one end pivoted at the one roller of the other roller pair and having an opposite end pivoted on the opposite end of the input link, the intermediate gear being mounted and rotatable on the opposite ends of the links.

* * * * *